US007552767B2

(12) United States Patent
Wood

(10) Patent No.: US 7,552,767 B2
(45) Date of Patent: Jun. 30, 2009

(54) CLOSEABLE OPEN CELL FOAM FOR DOWNHOLE USE

(75) Inventor: Edward T. Wood, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 406 days.

(21) Appl. No.: 11/487,220

(22) Filed: Jul. 14, 2006

(65) Prior Publication Data

US 2008/0042362 A1 Feb. 21, 2008

(51) Int. Cl.
*E21B 33/127* (2006.01)

(52) U.S. Cl. ..... 166/179; 166/387; 277/336

(58) Field of Classification Search ..... 166/179, 166/206, 207, 387; 277/336
See application file for complete search history.

(56) References Cited

U.S. PATENT DOCUMENTS

| | | | | |
|---|---|---|---|---|
| 3,918,523 | A | 11/1975 | Stuber | |
| 4,137,970 | A | 2/1979 | Laflin et al. | |
| 4,612,985 | A | 9/1986 | Rubbo et al. | |
| 4,862,967 | A | 9/1989 | Harris | |
| 4,919,989 | A | 4/1990 | Colangelo | |
| 4,936,386 | A | 6/1990 | Colangelo | |
| 5,048,605 | A | 9/1991 | Toon et al. | |
| 5,195,583 | A | 3/1993 | Toon et al. | |
| 5,803,172 | A | 9/1998 | Rajkovich | |
| 6,073,692 | A | 6/2000 | Wood et al. | |
| 6,769,484 | B2 * | 8/2004 | Longmore | 166/207 |
| 6,834,725 | B2 | 12/2004 | Whanger et al. | |
| 6,848,505 | B2 | 2/2005 | Richard et al. | |
| 6,854,522 | B2 | 2/2005 | Brezinski et al. | |
| 7,048,048 | B2 * | 5/2006 | Nguyen et al. | 166/227 |
| 2004/0020662 | A1 | 2/2004 | Freyer | |
| 2004/0040703 | A1 * | 3/2004 | Longmore | 166/207 |
| 2004/0055758 | A1 | 3/2004 | Brezinski et al. | |

(Continued)

FOREIGN PATENT DOCUMENTS

| | | |
|---|---|---|
| JP | 04-363499 | 12/1992 |

(Continued)

OTHER PUBLICATIONS

Ali, E., et al., "Effective Gas Shutoff Treatments in a Fractured Carbonate Filed in Oman", SPE 102244, Sep. 2006, 1-12.

(Continued)

*Primary Examiner*—Shane Bomar
(74) *Attorney, Agent, or Firm*—Steve Rosenblatt

(57) ABSTRACT

A downhole packer or sealing device uses a swelling sealing element that is initially held in a compressed state. Exposure to well or other fluids occurs downhole as the initial restraint on the element is overcome. The element takes on well fluids as it resumes its relaxed position or swells. The element is preferably an open cell material such as foam and has another material in its passages. The material in the passages, when exposed to well fluids, itself grows in size and can get harder. It blocks or seals the passages in the foam so that the swollen foam becomes more like a closed cell material and can retain a seal against a greater range of operating conditions than had its passages remained open or unobstructed with another material.

21 Claims, 1 Drawing Sheet

U.S. PATENT DOCUMENTS

| | | | | |
|---|---|---|---|---|
| 2004/0055760 | A1 | 3/2004 | Nguyen | |
| 2004/0118572 | A1 | 6/2004 | Whanger et al. | |
| 2004/0194971 | A1 | 10/2004 | Thomson | |
| 2004/0261990 | A1 | 12/2004 | Bosma et al. | |
| 2004/0261994 | A1* | 12/2004 | Nguyen et al. | 166/278 |
| 2005/0067170 | A1 | 3/2005 | Richard | |
| 2005/0092363 | A1 | 5/2005 | Richard et al. | |
| 2005/0092485 | A1* | 5/2005 | Brezinski et al. | 166/207 |
| 2005/0103493 | A1* | 5/2005 | Stevens et al. | 166/265 |
| 2005/0110217 | A1 | 5/2005 | Wood et al. | |
| 2006/0042798 | A1* | 3/2006 | Badalamenti et al. | 166/285 |
| 2006/0124304 | A1* | 6/2006 | Bloess et al. | 166/285 |
| 2007/0056795 | A1* | 3/2007 | Cox et al. | 181/111 |
| 2007/0095538 | A1* | 5/2007 | Szarka et al. | 166/308.1 |
| 2007/0183919 | A1* | 8/2007 | Ayer et al. | 419/2 |
| 2008/0087431 | A1* | 4/2008 | Willauer et al. | 166/290 |

FOREIGN PATENT DOCUMENTS

| | | |
|---|---|---|
| JP | 09-151686 | 6/1997 |
| JP | 2000-064764 | 2/2000 |
| WO | WO 2004/018836 A1 | 3/2004 |

OTHER PUBLICATIONS

Dubais, A.M., et at., "Field Cases to Demonstrate Application of Through Tubing Inflatable Anchoring Packer to Selectively Stimulate Vertical Dump of Water Injector Wells with Cross Flowing Zones", SPE 88590, Oct. 2004, 1-8.

* cited by examiner

CLOSEABLE OPEN CELL FOAM FOR DOWNHOLE USE

FIELD OF THE INVENTION

The field of this invention is sealing devices downhole and more particularly those that involve a sealing element that swells with exposure to fluids and most particularly to an element whose passages get blocked when swelling occurs.

BACKGROUND OF THE INVENTION

Packers are used downhole to isolate portions of a wellbore from each other. There are many styles of packers. Some set by longitudinal compression of the sealing element by fluid pressure applied to a setting tool or by mechanical force such as from setting down weight. Other designs involve elements that are inflated. More recently, elements that swell to a sealing position on exposure to well fluids have been used. There have been many variations as outlined below.

Packers have been used that employ elements that respond to the surrounding well fluids and swell to form a seal. Many different materials have been disclosed as capable of having this feature and some designs have gone further to prevent swelling until the packer is close to the position where it will be set. These designs were still limited to the amount of swelling from the sealing element as far as the developed contact pressure against the surrounding tubular or wellbore. The amount of contact pressure is a factor in the ability to control the level of differential pressure. In some designs there were also issues of extrusion of the sealing element in a longitudinal direction as it swelled radially but no solutions were offered. A fairly comprehensive summation of the swelling packer art appears below:

I. References Showing a Removable Cover Over a Swelling Sleeve

1) Application US 2004/0055760 A1

FIG. 2*a* shows a wrapping 110 over a swelling material 102. Paragraph 20 reveals the material 110 can be removed mechanically by cutting or chemically by dissolving or by using heat, time or stress or other ways known in the art. Barrier 110 is described in paragraph 21 as an isolation material until activation of the underlying material is desired. Mechanical expansion of the underlying pipe is also contemplated in a variety of techniques described in paragraph 24.

2) Application US 2004/0194971 A1

This reference discusses in paragraph 49 the use of water or alkali soluble polymeric covering so that the actuating agent can contact the elastomeric material lying below for the purpose of delaying swelling. One way to accomplish the delay is to require injection into the well of the material that will remove the covering. The delay in swelling gives time to position the tubular where needed before it is expanded. Multiple bands of swelling material are illustrated with the uppermost and lowermost acting as extrusion barriers.

3) Application US 2004/0118572 A1

In paragraph 37 of this reference it states that the protective layer 145 avoids premature swelling before the downhole destination is reached. The cover does not swell substantially when contacted by the activating agent but it is strong enough to resist tears or damage on delivery to the downhole location. When the downhole location is reached, pipe expansion breaks the covering 145 to expose swelling elastomers 140 to the activating agent. The protective layer can be Mylar or plastic.

4) U.S. Pat. No. 4,862,967

Here the packing element is an elastomer that is wrapped with an imperforate cover. The coating retards swelling until the packing element is actuated at which point the cover is "disrupted" and swelling of the underlying seal can begin in earnest, as reported in Column 7.

5) U.S. Pat. No. 6,854,522

This patent has many embodiments. The one in FIG. 26 is foam that is retained for run in and when the proper depth is reached expansion of the tubular breaks the retainer 272 to allow the foam to swell to its original dimension.

6) Application US 2004/0020662 A1

A permeable outer layer 10 covers the swelling layer 12 and has a higher resistance to swelling than the core swelling layer 12. Specific material choices are given in paragraphs 17 and 19. What happens to the cover 10 during swelling is not made clear but it presumably tears and fragments of it remain in the vicinity of the swelling seal.

7) U.S. Pat. No. 3,918,523

The swelling element is covered in treated burlap to delay swelling until the desired wellbore location is reached. The coating then dissolves of the burlap allowing fluid to go through the burlap to get to the swelling element 24 which expands and bursts the cover 20, as reported in the top of Column 8)

8) U.S. Pat. No. 4,612,985

A seal stack to be inserted in a seal bore of a downhole tool is covered by a sleeve shearably mounted to a mandrel. The sleeve is stopped ahead of the seal bore as the seal first become unconstrained just as they are advanced into the seal bore.

II. References Showing a Swelling Material Under an Impervious Sleeve

1) Application US 2005/0110217

An inflatable packer is filled with material that swells when a swelling agent is introduced to it.

2) U.S. Pat. No. 6,073,692

A packer has a fluted mandrel and is covered by a sealing element. Hardening ingredients are kept apart from each other for run in. Thereafter, the mandrel is expanded to a circular cross section and the ingredients below the outer sleeve mix and harden. Swelling does not necessarily result.

3) U.S. Pat. No. 6,834,725

FIG. 3*b* shows a swelling component 230 under a sealing element 220 so that upon tubular expansion with swage 175 the plugs 210 are knocked off allowing activating fluid to reach the swelling material 230 under the cover of the sealing material 220.

4) U.S. Pat. No. 5,048,605

A water expandable material is wrapped in overlapping Kevlar sheets. Expansion from below partially unravels the Kevlar until it contacts the borehole wall.

5) U.S. Pat. No. 5,195,583

Clay is covered in rubber and a passage leading from the annular space allows well fluid behind the rubber to let the clay swell under the rubber.

6) Japan Application 07-334115

Water is stored adjacent a swelling material and is allowed to intermingle with the swelling material under a sheath 16.

III. References Which Show an Exposed Sealing Element that Swells on Insertion

1) U.S. Pat. No. 6,848,505

An exposed rubber sleeve swells when introduced downhole. The tubing or casing can also be expanded with a swage.

2) PCT Application WO 2004/018836 A1

A porous sleeve over a perforated pipe swells when introduced to well fluids. The base pipe is expanded downhole.

3) U.S. Pat. No. 4,137,970

A swelling material 16 around a pipe is introduced into the wellbore and swells to seal the wellbore.

4) U.S. Application US 2004/0261990

Alternating exposed rings that respond to water or well fluids are provided for zone isolation regardless of whether the well is on production or is producing water.

5) Japan Application 03-166,459

A sandwich of slower swelling rings surrounds a faster swelling ring. The slower swelling ring swells in hours while the surrounding faster swelling rings do so in minutes.

6) Japan Application 10-235,996

Sequential swelling from rings below to rings above trapping water in between appears to be what happens from a hard to read literal English translation from Japanese.

7) U.S. Pat. Nos. 4,919,989 and 4,936,386

Bentonite clay rings are dropped downhole and swell to seal the annular space, in these two related patents.

8) US Application US 2005/0092363 A1

Base pipe openings are plugged with a material that disintegrates under exposure to well fluids and temperatures and produces a product that removes filter cake from the screen.

9) U.S. Pat. No. 6,854,522

FIG. 10 of this patent has two materials that are allowed to mix because of tubular expansion between sealing elements that contain the combined chemicals until they set up.

10) U.S. Application US 2005/0067170 A1

Shape memory foam is configured small for a run in dimension and then run in and allowed to assume its former shape using a temperature stimulus.

Swelling materials such as foams are generally porous structures so that even when they swell or are released from a confined position and allowed to take on well fluids and resume a relaxed position are still limited in their sealing ability. With the passages in the foam still open even after swelling, increases in differential pressure can still reshape the element and perhaps cause leakage past it. What is needed is a swelling element that has the capability of obstructing or even sealing off passages within it in conjunction with swelling so that the resulting swollen structure is less porous or even impervious and that forms a more enduring seal. The present invention provides this structure and other features to enhance the sealing capability of downhole devices. The invention will be more readily understood by those skilled in the art from a review of the description of the preferred embodiment and the associated drawings while the appended claims below define the full scope of the invention.

SUMMARY OF THE INVENTION

A downhole packer or sealing device uses a swelling sealing element that is initially held in a compressed state. Exposure to well or other fluids occurs downhole as the initial restraint on the element is overcome. The element takes on well fluids as it resumes its relaxed position or swells. The element is preferably an open cell material such as foam and has another material in its passages. The material in the passages, when exposed to well fluids, itself grows in size and can get harder. It blocks or seals the passages in the foam so that the swollen foam becomes more like a closed cell material and can retain a seal against a greater range of operating conditions than had its passages remained open or unobstructed with another material.

DETAILED DESCRIPTION OF THE PREFERRED EMBODIMENT

Figure 1:
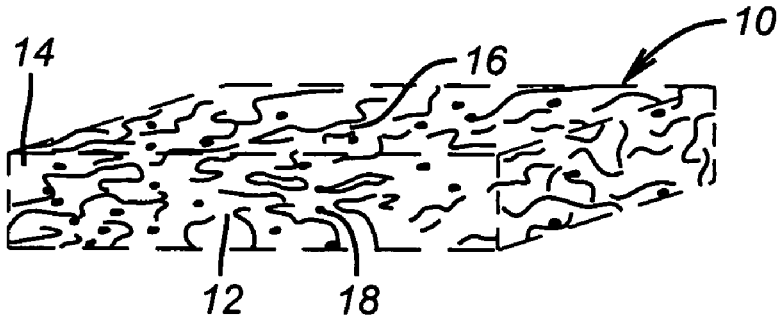
FIG. 1 shows a portion of a sealing element with particles in the passages and the element in the relaxed state.

FIG. 1 shows a section of a sealing element 10 that can be fashioned into an annular cylindrical shape for mounting on a mandrel (not shown). In the preferred embodiment the element 10 is open cell foam featuring a plurality of openings 12 that extend to its outer dimension 14. These openings 12 are part of a network of passages 16 that pass through the element 10. Preferably located in the passages 16 or near them are particles 18. The particles 18 can be a swelling material such as a clay and more particularly bentonite clay that when it comes into contact with well fluids or fluids added to the well itself preferably swells and/or preferably becomes hard and/or preferably agglomerates with similar particles with which it makes contact.

Figure 2:
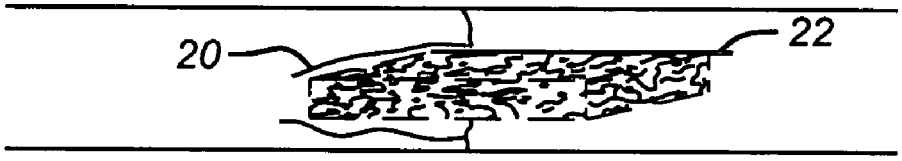
FIG. 2 is the view of FIG. 1 with the element pre-compressed into the condition that it will be run in a well.

As shown in FIG. 2, it is preferred to pre-compress the element 10 from the relaxed position in FIG. 1 to the compressed position in FIG. 2 before running it into a well. This can be accomplished in many ways. In one embodiment, shown schematically in FIG. 2 the element 10 can be disposed inside an inflatable element 20. The uninflated element 20 can be the compressing force to get the element 10 that is inside it into the precompressed shape shown in FIG. 2. As soon as inflation fluid is allowed to enter the element 20 it grows in size and allows the interior swelling element 10 the room to swell beyond its relaxed position as it takes in the fluid into passages 16. At the same time the fluid contacts the particles 18 which preferably swell and get hard but at least change condition to the point where they at least obstruct the passages 16 if not seal them off completely. The growth of the element 10 within the inflatable 20 helps the inflatable 20 hold the seal and can back up the inflatable 20 even if it were to get damaged or even rupture by holding it in the extended position for continued sealing. The obstruction or sealing of the passages 16 combined with the overall swelling of the element 10 beyond its relaxed dimension gives the element 10 in its enlarged configuration additional rigidity to hold a seal downhole. Hardening of the particles 18, apart from their swelling in the passages 16 further helps to retain the fluids brought into the element 10 as it is allowed to contact well fluids or added fluids and swell. Blocking the passages or sealing them further adds strength to the element 10 and better insures that it will seal. All this is applicable regardless of whether the element 10 is inside an inflatable or is an exposed sealing element on a packer, for example.

Figure 3:
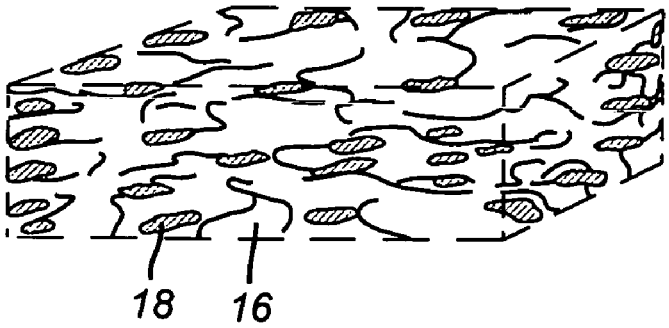
FIG. 3 is the view of FIG. 2 after the element is allowed to swell and take on well fluids and showing the effect of well fluids on the particles in the passages.

FIG. 3 illustrates the swelled condition of the element 10 showing the particles 18 in an enlarged condition and blocking or sealing the passages 16.

The element 10 when used exposed as a packer can be bound in a variety of ways to assume the compressed state of FIG. 2. It can have an outer covering that breaks off from exposure to well fluids or fluids added to the well. It can be bound with fasteners that release from exposure to well fluids or by mandrel expansion or by a release of other types of locking devices. The outer covering, shown schematically as 22 in FIG. 2, also prevents the onset of swelling of the element 10 by temporarily isolating well fluids until the cover 22 is removed. The element can then relax and resume its original dimension and swell even larger and as it does so it takes in surrounding well fluids. In the case of an open cell foam with particles 18 in or near the passages 16, the open cell structure moves toward being a completely closed cell structure as the particles 18 get exposed to well fluids and begin to grow and preferably get hard and preferably block if not seal off some or all of the passages 16. The particles can be incorporated into the element 10 during the manufacturing process or be forced into the structure afterwards.

The removal of the cover or restraint 22 allows well fluids or fluids added to the well to get into the passages 16 and reach the particles 18. The particles 18 preferably begin to swell and get hard and assume a size at least a third of the cross sectional area of the passages 16 in their swollen condition. In that way the particles 18 are more likely to agglomerate in passages 16 when encountering each other as oppose to simply flowing through the passages 16 and passing out of the element 10. The base material is preferably open cell foam such as nitrile and the preferred material 18 is bentonite clay. Other base materials that can be used include Polyurethane, EPDM, HNBR, or Viton. Choices for the obstructing material 18 can be any one of a number of Super Absorbent Polymers.

The above description is illustrative of the preferred embodiment and many modifications may be made by those skilled in the art without departing from the invention whose scope is to be determined from the literal and equivalent scope of the claims below.

I claim:

1. A sealing element for downhole use on a tubular string, comprising:

a base material that comprises an open structure defining passages therethrough that can take in fluids downhole; and a second material disposed within said base material that changes dimension when exposed to downhole fluids in said passages to at least partially obstruct them;

said base material and second material are mounted on a mandrel and within an annular space defined by a sealing element of an inflatable packer, said mandrel having an inlet to the annular space from within the tubular string whereupon, after inflation from fluid in said tubular strings, said base and second materials enhance the seal provided by the inflation fluid in said sealing element.

2. The element of claim 1, wherein:

said base material has a relaxed dimension and is resilient to allow compression of it to a dimension smaller than its relaxed dimension for running downhole.

3. The element of claim 2, wherein:

said base material moves toward resuming its relaxed dimension when no longer compressed.

4. The element of claim 3, wherein:

downhole fluids entering said passages drive said base material toward said relaxed dimension.

5. The element of claim 4, wherein:

said second material changes dimension when exposed to downhole fluids in said passages.

6. The element of claim 5, wherein:

said second material at least obstructs a plurality of said passages when exposed to downhole fluids.

7. The element of claim 6, wherein:

said second material seals off a plurality of said passages when exposed to downhole fluids.

8. The element of claim 7, wherein:

said second material comprises a swelling clay.

9. The element of claim 8, wherein:

said second material comprises bentonite.

10. The element of claim 1, wherein:

said base material and second material are disposed within a cover;

said cover is removed by virtue of exposure to well fluids for a predetermined time.

11. The element of claim 2, wherein:

said base material is retained in a dimension smaller than said relaxed dimension by a retainer that is removable downhole.

12. The element of claim 11, wherein:

said base material is mounted on a mandrel;

said retainer is removed by radial expansion of said mandrel.

13. The element of claim 5, wherein:

said second material becomes harder on exposure to well fluids.

14. The element of claim 1, wherein:

said base material comprises an open cell foam.

15. The element of claim 4, wherein:

said base material swells beyond its relaxed dimension when downhole fluid enters said passages.

16. The element of claim 15, wherein:

said second material changes dimension when exposed to downhole fluids in said passages.

17. The element of claim 16, wherein:

said second material at least obstructs a plurality of said passages when exposed to downhole fluids.

18. The element of claim 17, wherein:

said second material seals off a plurality of said passages when exposed to downhole fluids.

19. The element of claim 18, wherein:

said second material comprises a swelling clay.

20. The element of claim 1, wherein:

said second material comprises discrete particles that agglomerate with each other in said passages on exposure to downhole fluids.

21. The element of claim 20, wherein:

the cross-sectional area of said particles of said second material after exposure to downhole fluids is at least one third the cross-sectional area of the passage in which it is then disposed.

* * * * *